US010518269B2

(12) United States Patent
Boivin et al.

(10) Patent No.: US 10,518,269 B2
(45) Date of Patent: Dec. 31, 2019

(54) GRINDING MILL WITH SECURING FRAME

(71) Applicant: SPEX SamplePrep, LLC, Metuchen, NJ (US)

(72) Inventors: Marc Boivin, Wendake (CA); Pierre-Emmanuel LeMay, Quebec (CA); Antoine Fiala, Saint-Romuald (CA); Marco Bernier, Quebec (CA)

(73) Assignee: SPEX SamplePrep, LLC, Metuchen, NJ (US)

( * ) Notice: Subject to any disclaimer, the term of this patent is extended or adjusted under 35 U.S.C. 154(b) by 159 days.

(21) Appl. No.: 15/783,632

(22) Filed: Oct. 13, 2017

(65) Prior Publication Data

US 2019/0111438 A1 Apr. 18, 2019

(51) Int. Cl.

| | |
|---|---|
| ***B02C 17/00*** | (2006.01) |
| ***B02C 17/14*** | (2006.01) |
| ***B02C 19/16*** | (2006.01) |
| ***B02C 21/02*** | (2006.01) |
| ***B02C 17/18*** | (2006.01) |
| ***B02C 23/04*** | (2006.01) |

(52) U.S. Cl.

CPC ..... *B02C 17/14* (2013.01); *B02C 17/18* (2013.01); *B02C 19/16* (2013.01); *B02C 21/02* (2013.01); *B02C 23/04* (2013.01)

(58) Field of Classification Search

CPC ..... B02C 17/14; B02C 19/16
USPC ..... 241/175, 270, 286, 285.1
See application file for complete search history.

(56) References Cited

U.S. PATENT DOCUMENTS 85,354 A * 12/1868 Ball ..... B02C 17/14 241/175
90,994 A * 6/1869 Clareton ..... B02C 1/14 241/199.11
165,442 A * 7/1875 Goddard ..... B02C 17/14 241/199.1
259,769 A * 6/1882 Lippitt ..... B02C 17/161 241/69

(Continued)

FOREIGN PATENT DOCUMENTS

| | | | |
|---|---|---|---|
| KR | 20090087527 | A | 8/2009 |
| WO | 03066221 | A2 | 8/2003 |
| WO | 2016131433 | A1 | 8/2016 |

OTHER PUBLICATIONS

International Search Report for PCT/US2018/055427, dated Feb. 12, 2019.

*Primary Examiner* — Faye Francis
(74) *Attorney, Agent, or Firm* — Lerner, David, Littenberg, Krumholz & Mentlik, LLP

(57) ABSTRACT

A grinding mill for pulverizing material includes a platform having an upper surface and defining a recess having a floor, the recess configured to seat a dish in which the material is disposed, and a movable securing frame that is movably connected with the platform, the frame including a lift support having an upper surface that is movable along a path from a first location that is beneath the floor of the recess, through the recess, to a second location that is coplanar with the upper surface of the platform. A motor configured to cause oscillation of the platform and the movable securing frame can be used. A method of using the grinding mill can include placing a dish above a recess defined by an upper surface of a platform, and lowering the frame with respect to the platform, thereby seating the dish within the recess.

20 Claims, 6 Drawing Sheets

(56) References Cited

U.S. PATENT DOCUMENTS 720,054 A * 2/1903 McKinney ..... B02C 1/14 241/270
1,759,245 A * 5/1930 Schultz ..... B02C 19/08 241/199.1
2,328,213 A * 8/1943 Hollenback ..... A61C 5/68 241/199
2,391,953 A * 1/1946 Duty ..... B02C 19/08 241/199.1
2,572,378 A * 10/1951 Milton ..... A47J 43/26 100/101
2,760,729 A * 8/1956 Mittag ..... B02C 17/14 241/137
3,514,907 A * 6/1970 Strom ..... B24B 31/073 241/175
3,552,068 A * 1/1971 Van Fossen ..... B24B 31/062 241/175
3,840,191 A * 10/1974 Herzog ..... B02C 17/14 241/199.1
3,882,643 A 5/1975 Knartzer
4,042,181 A * 8/1977 Huber ..... B02C 17/14 241/175
4,607,801 A 8/1986 Harvey
4,640,468 A * 2/1987 Quinn ..... B02C 17/14 241/199.1
5,803,800 A * 9/1998 Kobayashi ..... B24B 31/073 241/175
6,123,278 A * 9/2000 Chaplenko ..... B02C 17/14 241/199.1
6,935,585 B1 8/2005 Hobson
7,681,818 B2 * 3/2010 Peterson ..... A23G 1/0016 241/153
8,042,754 B2 10/2011 Mahler et al.
8,201,767 B2 * 6/2012 Wright ..... B02C 18/04 241/262
8,404,197 B2 3/2013 Solazzi
8,720,806 B2 5/2014 Mahler
2003/0025018 A1 2/2003 Mashburn et al.
2003/0146313 A1 * 8/2003 Deppemiann ..... B02C 17/10 241/30
2004/0251353 A1 * 12/2004 Berselli ..... B02C 17/14 241/175
2005/0017110 A1 1/2005 Johnson et al.
2015/0336105 A1 * 11/2015 Wagner ..... B02C 19/20 241/89.3
2016/0121336 A1 5/2016 Yalin et al.
2016/0256871 A1 9/2016 Dulmes
2017/0014830 A1 1/2017 Simons et al.
2018/0339297 A1 11/2018 Scharfe

* cited by examiner

GRINDING MILL WITH SECURING FRAME

BACKGROUND OF THE INVENTION

The present invention generally relates to grinding mills, and more particularly to grinding mills and methods of their use incorporating movable frames to enhance the safety and ease of using such systems.

Grinding mills are useful for pulverizing certain materials. Generally, those materials and pulverizing elements are loaded into a dish, and the dish is in turn loaded into a machine that significantly oscillates to agitate the contents of the dish. The dish can have a substantial weight, which is increased by the weight of its contents, that makes loading and unloading the dish into the grinding mill cumbersome and difficult. Moreover, the strong forces to which the heavy dish are subjected can be dangerous when the systems and components used to hold the dish in place wear out or are not strong enough to perform their intended tasks. Properly and completely securing the dish is critical for efficiency and safety.

There remains room for improvement in the design and use of grinding mills, particularly with regard to loading and unloading heavy dishes and securing same during operation.

BRIEF SUMMARY OF THE INVENTION

A first aspect of the present invention is grinding mill for pulverizing material, including a platform having an upper surface and defining a recess having a floor, the recess configured to seat a dish in which the material is disposed, and a movable securing frame that is movably connected with the platform, the frame including a lift support having an upper surface that is movable along a path from a first location that is beneath the floor of the recess, through the recess, to a second location that is coplanar with the upper surface of the platform.

In other embodiments according to the first aspect, the grinding mill may further include a motor configured to cause oscillation of the platform and the movable securing frame. The grinding mill may further include a counterweight configured to be rotated by the motor to counterbalance the oscillation of the platform and the movable securing frame. The grinding mill may further include an annular disc to which the counterweight is secured. The annular disc may be located on the upper surface of the platform. The counterweight may be located at a point along a circumference of the annular disc.

The grinding mill may further include a housing rigidly secured to the platform. The housing may be disposed above the upper surface of the platform. The grinding mill may further include an actuator and a rod connected to an upper support of the frame, wherein the actuator is configured to translate the rod to move the frame with respect to the housing. The actuator may be a motor and the rod may be threaded. The rod may extend through an aperture of the housing, and the actuator may be secured to the housing.

The lift support may be movable within an opening defined by the floor of the recess. The frame may further include a second lift support having an upper surface that is movable along the path from the first location, through the recess, to the second location. A height of the lift support may be at least as tall as a height of the platform. An upper support of the frame may have a lower surface and a boss extending downward from the lower surface. The boss may be cup-shaped and may define a depression that faces downward toward the lift support. The grinding mill may further include a dish including a base and a lid, wherein the lid has an upper surface and a knob extending upward from the upper surface. The cross-sections of the depression and the knob may be substantially identical in geometry.

The grinding mill may further include a plurality of pillars supporting the platform. Each of the plurality of pillars may be made of a rubber material. The grinding mill may further include an actuator and a rod connected to the frame, wherein the actuator is configured to translate the rod to move the frame with respect to the platform. The actuator may be a motor and the rod may be threaded. The grinding mill may further include a dish including a base and a lid. The recess may be cylindrical. The grinding mill may further include a U-shaped collar disposed on the upper surface of the platform to guide the dish toward the recess.

A second aspect of the present invention is a grinding mill for pulverizing material, including a platform having an upper surface and defining a recess having a floor, the recess configured to seat a dish in which the material is disposed, and a movable securing frame having an upper support with a clamping surface and a lower support with an lift surface, the frame being movably connected with the platform along a path defining a first position in which the lift surface of the lower support is beneath the floor of the recess and the clamping surface is in contact with the dish to clamp the dish between the clamping surface and the floor of the recess, and a second position in which the lift surface of the lower support is coplanar with the upper surface of the platform.

In other embodiments according to the second aspect, the frame may be further movable along the path to an intermediate position above the first position in which the lift surface of the lower support is beneath the floor of the recess and the clamping surface is separated from the dish. The clamping surface may face the upper surface of the lift support. The grinding mill may further include a dish including a base and a lid. The lower support may be movable within an opening defined by the floor of the recess.

The grinding mill may further include a motor configured to cause oscillation of the platform and the movable securing frame. The grinding mill may further include a counterweight configured to be rotated by the motor to counterbalance the oscillation of the platform and the movable securing frame. The grinding mill may further include an annular disc to which the counterweight is secured. The annular disc may be located on the upper surface of the platform. The counterweight may be located at a point along a circumference of the annular disc.

The grinding mill may further include a housing rigidly secured to the platform. The housing may be disposed above the upper surface of the platform. The grinding mill may further include an actuator and a rod connected to the upper support of the frame, wherein the actuator is configured to translate the rod to move the frame with respect to the housing. The actuator may be a motor and the rod may be threaded. The rod may extend through an aperture of the housing, and the actuator may be secured to the housing.

The frame may further include a second lower support having a lift surface that is movable along the path. A height of the lower support may be at least as tall as a height of the platform. The upper support of the frame may have a boss extending downward from the clamping surface. The boss may be cup-shaped and may define a depression that faces downward toward the lower support.

The grinding mill may further include a dish including a base and a lid, wherein the lid of the dish has an upper surface and a knob extending upward from the upper surface. The cross-sections of the depression and the knob may be substantially identical in geometry. The grinding mill may further include a plurality of pillars supporting the platform. Each of the plurality of pillars may be made of a rubber material.

The grinding mill may further include an actuator and a rod connected to the frame, wherein the actuator is configured to translate the rod to move the frame with respect to the platform. The actuator may be a motor and the rod may be threaded. The recess may be cylindrical. The grinding mill may further include a U-shaped collar disposed on the upper surface of the platform to guide the dish toward the recess.

A third aspect of the present invention is a method of using a grinding mill for pulverizing material, including the steps of placing a dish containing materials to be pulverized above a recess defined by an upper surface of a platform, including seating the dish on an upper surface of a lift support of a movable securing frame that is movably connected with the platform, and lowering the frame with respect to the platform to lower the upper surface of the lift support through the recess to a location beneath a floor of the recess, thereby seating the dish within the recess.

In other embodiments according to the third aspect the method may further include the step of oscillating the platform, the movable securing frame, and the dish. The step of oscillating may include operating a motor. The step of oscillating may further include rotating a counterweight to counterbalance the oscillation of the platform, the movable securing frame, and the dish.

The step of lowering the frame may include powering an actuator to translate the frame. The step of powering the actuator may include powering a motor to translate a threaded rod connected to an upper support of the frame. The method may further include the step of monitoring torque and/or current applied by the motor used to translate the frame. The method may further include the step of increasing a force applied by the frame on the dish when it is detected that the force applied by the frame to the dish is too low. The method may further include the steps of oscillating the platform, the movable securing frame, and the dish, and ending the step of oscillating when it is detected that the force applied by the frame to the dish is too low.

The step of lowering may include lowering the lift support at least partially through an opening defined by the floor of the recess. The method may further include the step of lowering the frame further with respect to the platform to engage a boss extending downward from a lower surface of an upper support of the frame with the dish. The step of lowering the frame may further include engaging a depression defined in the boss with a knob on an upper surface of a lid of the dish.

The method may further include the step of clamping the dish between an upper support of the frame and the floor of the recess of the platform by lowering the frame further with respect to the platform. The method may further include the step of raising the frame with respect to the platform to raise the upper surface of the lift support through the recess to a location coplanar with the upper surface of the platform, thereby raising the dish out of the recess. The method may further include the step of moving the dish containing the pulverized materials on the upper surface of the platform away from the recess. The method may further include the step of monitoring an amplitude of the platform.

DETAILED DESCRIPTION

Figure 4:
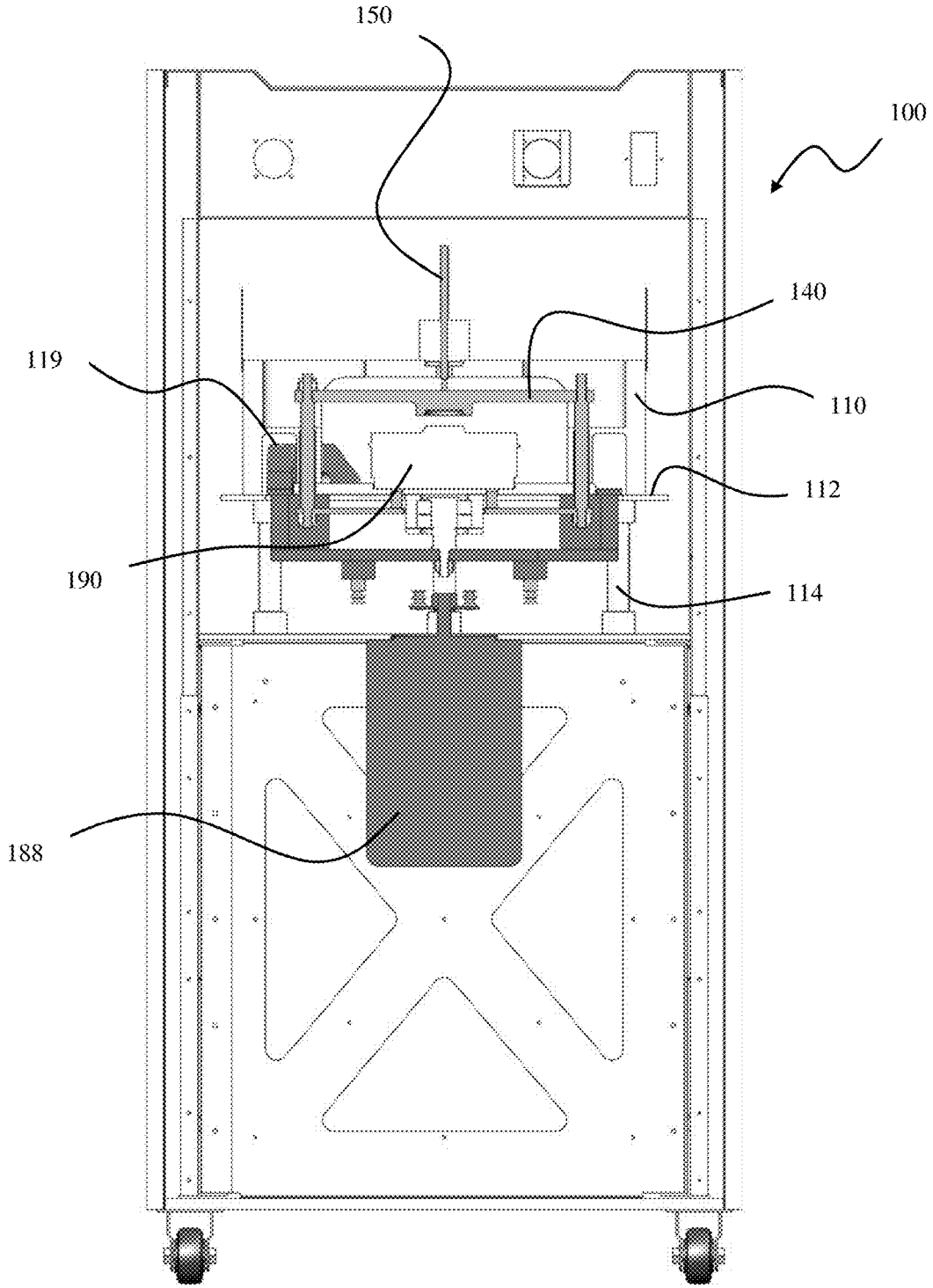
FIGS. 4 and 5 are sectional elevational views of the grinding mill of FIG. 1.
Figure 5:
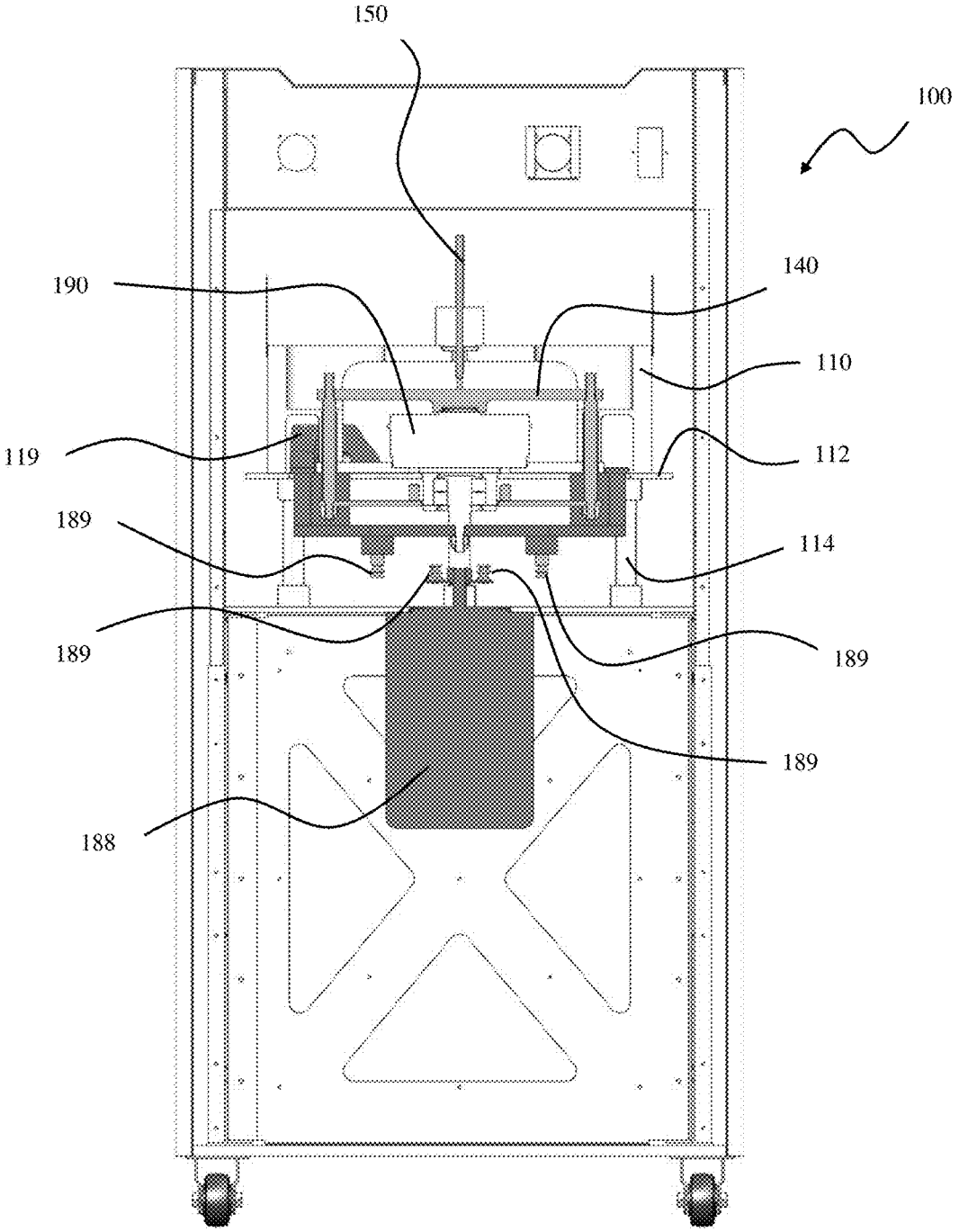
Figure 6:
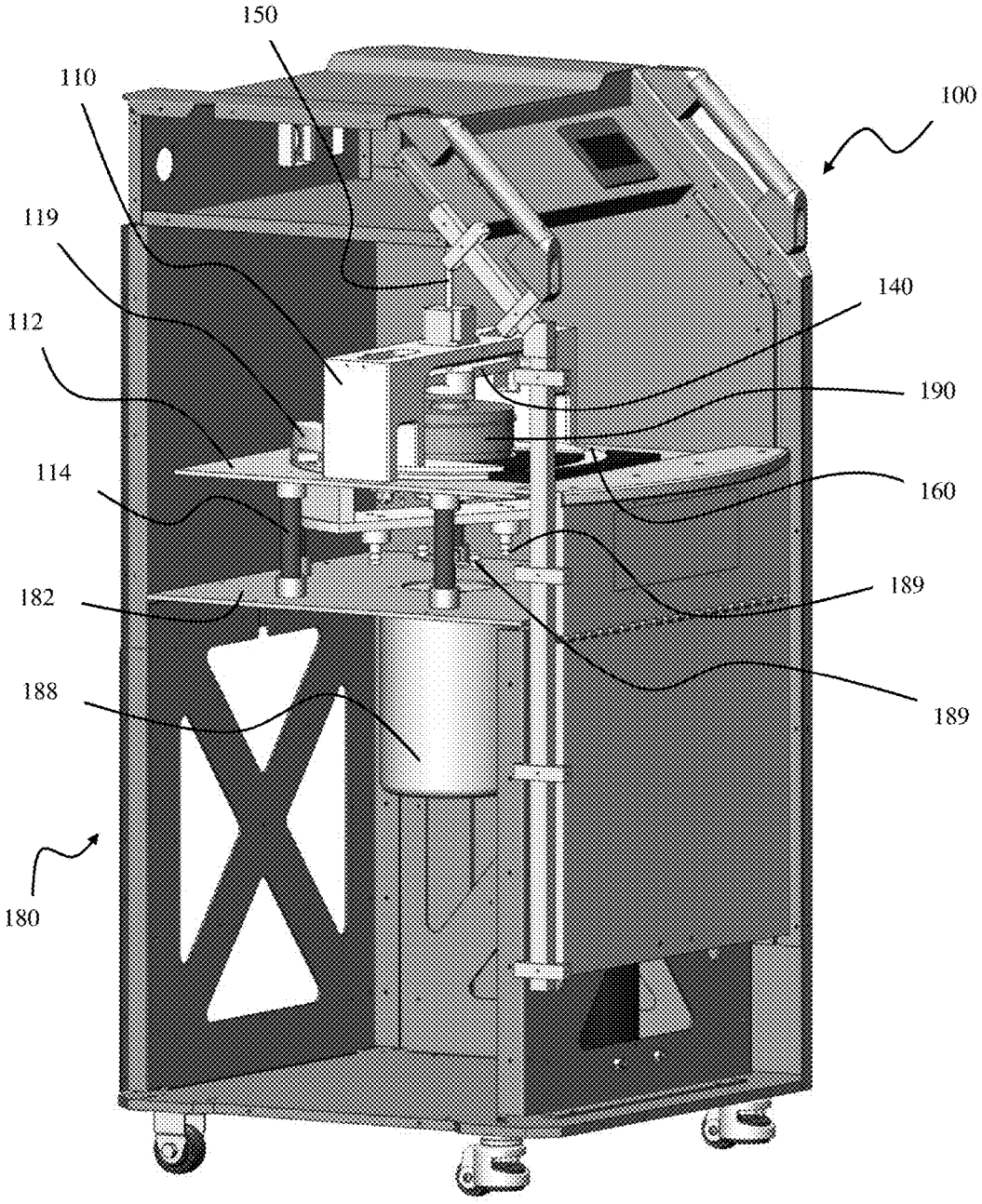
FIG. 6 is a front perspective view of the grinding mill of FIG. 1 showing internal components.

A first embodiment in accordance with the present invention is a grinding mill 100 as shown in FIGS. 1-6. Grinding mill 100 includes a housing 110 rigidly secured to a platform 112, which is supported by a plurality of pillars 114. Housing 110 includes two opposed vertical members 116, 118 and a horizontal member 120 connected at the top of both vertical members 116, 118. Pillars 114 are secured at their bases to a separate structure such as a table or directly to the ground. In the case of grinding mill 100, pillars 114 are fastened at their bases to a lower structure 182 inside a machine casing 180, as shown in FIG. 6.

Pillars 114 are constructed of a relatively rigid rubber material or other similar type of material to provide stability to platform 112 and the other elements of grinding mill 100 while also absorbing vibration, oscillation, and rotational forces imparted during to operation of grinding mill 100. In alternate embodiments, a grinding mill can use as pillars any other flexible material and/or geometric construction, such as springs for example. Pillars 114 also play an important role to control the amplitude of the motion of grinding mill 100. Above the resonant frequency, the amplitude of the oscillation will be determined by the difference of the force generated by a counterweight 119 in rotation and the motion of platform 112, which are opposed as described below.

Grinding mill 100 further includes a securing frame 140 that is vertically movable with respect to housing 110 and platform 112. Frame 140 includes a base support 142 disposed beneath platform 112, two opposed vertical posts 144, 146 extending upward from base support 142, and an upper support 148 that is connected to both vertical posts 144, 146 and located beneath horizontal member 120. Upper support 148 has a clamping surface in its lower side that faces dish 190. Vertical posts 144, 146 are generally disposed within respective vertical members 116, 118 of housing 110. In that way, frame 140 is generally guided in its movement through its cooperation with housing 110 and platform 112, though it need not be completely disposed within portions of housing 110 and platform 112. Frame 140 further includes a threaded rod 150 fixedly secured to and extending vertically upward from upper support 148 through an aperture 121 in horizontal member 120 of housing 110.

A step motor 152 is disposed above and is firmly and fixedly secured to horizontal member 120 of housing 110 at aperture 121. Step motor 152 can be at least partially disposed within a recess 123 at the top surface of horizontal member 120 to accommodate the physical shape of step motor 152. Recess 123 can be necessary when a precise positioning of step motor 152 is required. Step motor 152 includes an internal rotational mechanism, such as a nut, that engages threaded rod 150. The internal nut rotor rotates and engages threaded rod 150 to translate threaded rod 150 vertically in either direction, thereby raising and lowering securing frame 140 vertically within housing 110 and platform 112. Threaded rod 150 itself does not rotate due to the way it is fastened to frame 140. In an alternative embodiment, rod 150 could be rotated if attached to the motor axis and the nut is attached to the moving frame 140. Other types of actuators can be used in place of step motor 152, such as magnetic, pneumatic, and hydraulic actuators and the like, so long as the same function is performed to translate a rod (threaded or not) vertically. Additionally, step motor 150 or any actuator could be positioned beneath securing frame 140 with threaded rod 150 attached to base support 142, or to one side of securing frame 140 with an attachment to one of vertical members 116, 118. Twin motors can also be used.

A dish 190 is utilized with grinding mill 100 and includes a base 192 and a lid 194. Dish 190 is secured within grinding mill 100 and subject to significant oscillation to agitate contents within base 192. Dish 190 is constructed of rigid material that is relatively heavy to withstand the influence of repeated strong oscillations. In some embodiments, dish 190 weighs approximately 30 pounds. Lid 194 can include an internal lip that provides a close, secure fit with base to prevent movement of lid 194 with respect to base 192. In this way, lid 194 self-centers on base 192 when the two are attached. A lock or clamp can be utilized to more securely attach lid 194 to base 192.

An annular disc 160 is a further component of grinding mill 100 that is located on the upper surface of platform 112. Other locations of annular disc 160 can be used as long as the rotation axis of annular disc 160 is perpendicular with the upper surface of platform 112. Annular disc 160 has an unbalanced weight distribution, such that counterweight 119 is located at a point along the circumference of annular disc 160 so that its overall weight is not uniformly distributed about the circumference. The center of mass of the counterweight 119 must be at the same height or within the same plane as the center of mass of dish 190 (that plane being coplanar with the upper surface of platform 112) to create an opposite force within that plane. In other embodiments, the counterweight can be an element that is offset from the axis of rotation of the motor that rotates it, such that it is not required to be on a disc, per se. The counterweight could be located on an extension arm of linear or other geometry that is rotated by a motor in a similar manner to annular disc 160. Ultimately, the objective achieved by rotation of counterweight 119 is not necessarily dependent on the structure with which it connects to the rotating motor.

Each of vertical members 116, 118 defines a respective tunnel 125, 127 through which annular disc 160 and counterweight 119 disposed thereon can pass. In this way, annular disc 160 creates a rotational imbalance when spun, which provides force which is opposite to the force created by the oscillation of the dish. Pillars 114 dampen the effect of the force to elements external to grinding mill 100. A grinding motor 188 beneath platform 112 causes rotational movement of annular disc 160. Motor 188 is linked to annular disc 160 through an offset flexible coupling, so that the rotational axis of motor 188 and the rotational axis of annular disc 160 are parallel but not collinear. The offset distance between these axes is opposed to the position of counterweight 119 on annular disc 160. That is, counterweight 119 is installed in an opposite direction of the offset. At slow speeds, this offset causes a circular translation of platform 112 by flexing pillars 114. At the same time, annular disc 160 rotates, with counterweight 119 in the opposed direction (i.e. 180 degrees) from the motion of platform 112. At high speeds (above the natural resonant frequency of grinding mill 100), a dynamic equilibrium is created between the translating mass of the platform assembly and the one of counterweight 119.

Within the circumference of annular disc 160, platform 112 defines a cylindrical recess 117 in which dish 190 is seated during use of grinding mill 100. Cylindrical recess 117 has a shape that matches the bottom of dish 190. Other matching shapes can be used, including square, triangular, rectangular, etc. As platform 112 is moved during operation of grinding mill 100, this seat provided to dish 190 helps to securely maintain the location of dish 190 on platform 112 to properly subject it to the imposed oscillations. The external dimensions and geometry of recess 117 closely match those of the lower end of dish 190 so that dish 190 can be secured during use. In this way, the forces and oscillations created by grinding mill 100 can be directly transmitted to dish 190. A collar 170 can be secured to the upper surface of platform 112 surrounding a portion of the circumference of recess 117. The U-shaped configuration of collar 170 creates a mouth that guides dish along the upper surface of platform 112 into its position within recess 117. This allows a user insert dish 190 to the exact location of recess 117 by merely pushing or sliding dish 190 towards the back of the machine. The wide angled sides of the mouth guide dish 190 laterally to the middle of recess 117. The end of the "U" stops the motion at the point where dish 190 is centered above recess 117. Recess 117 is not mandatory for operation of grinding mill 100, though it serves a securing purpose that can be otherwise accounted for by a vice grip or the use of frame 140.

The substantial weight of dish 190, enhanced by that of its contents, and the leverage required to place it into and remove it from recess 117 can make such tasks difficult. Particularly, the effort needed to drop dish 190 into recess 117 and to lift dish 190 out of recess 117 and onto platform 112 can be significant. Accordingly, base support 142 of frame 140 is provided with two lift pads or lower supports 154, 156 disposed on its upper surface. While two lift supports 154, 156 are herein shown and described, it is contemplated that one, three, or more lift supports can be utilized and made of any geometry to perform their purpose as stated herein.

Figure 1:
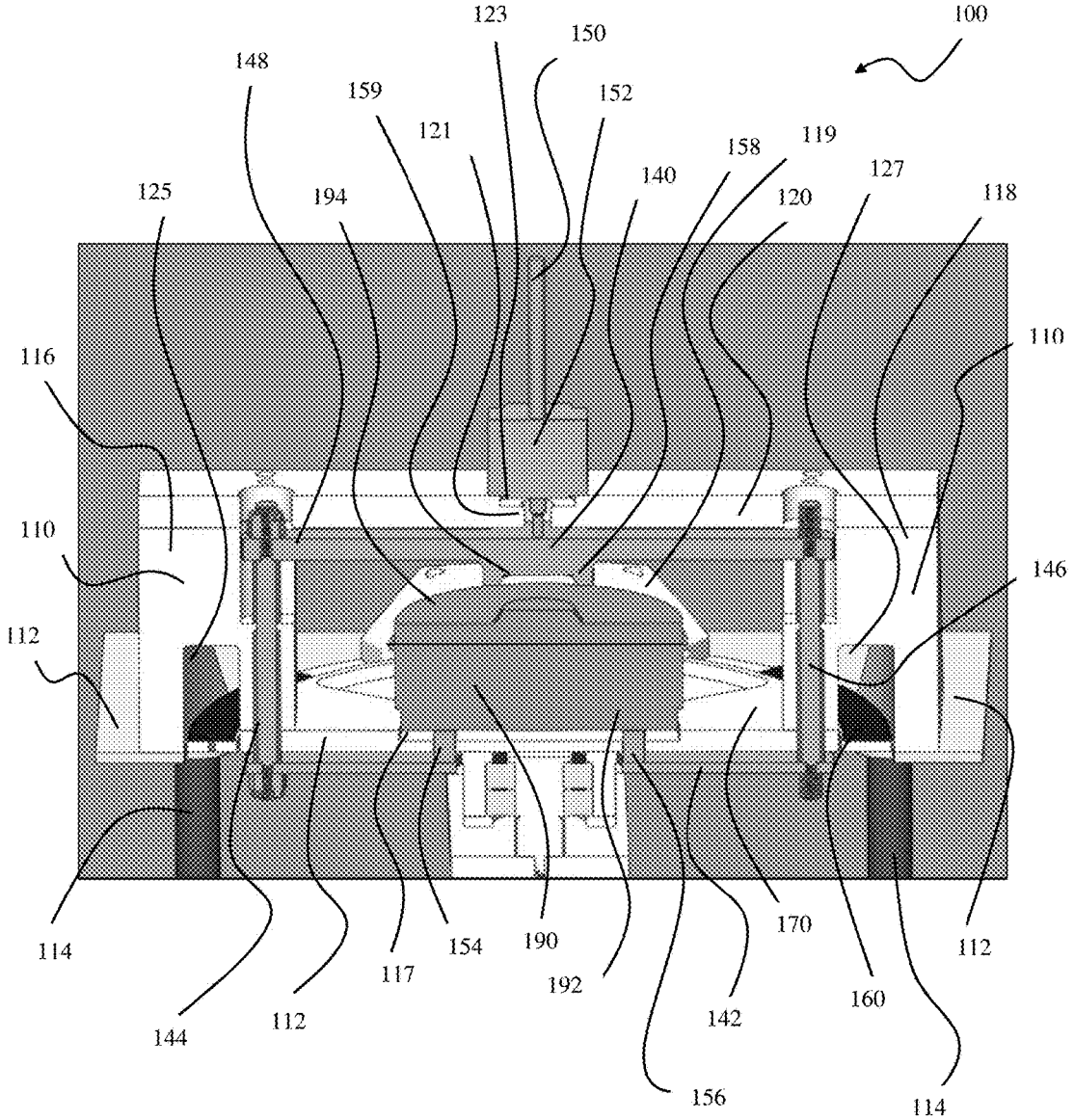
FIGS. 1 and 2 are sectional elevational views of certain components of a grinding mill in accordance with a first embodiment of the present invention.
Figure 2:
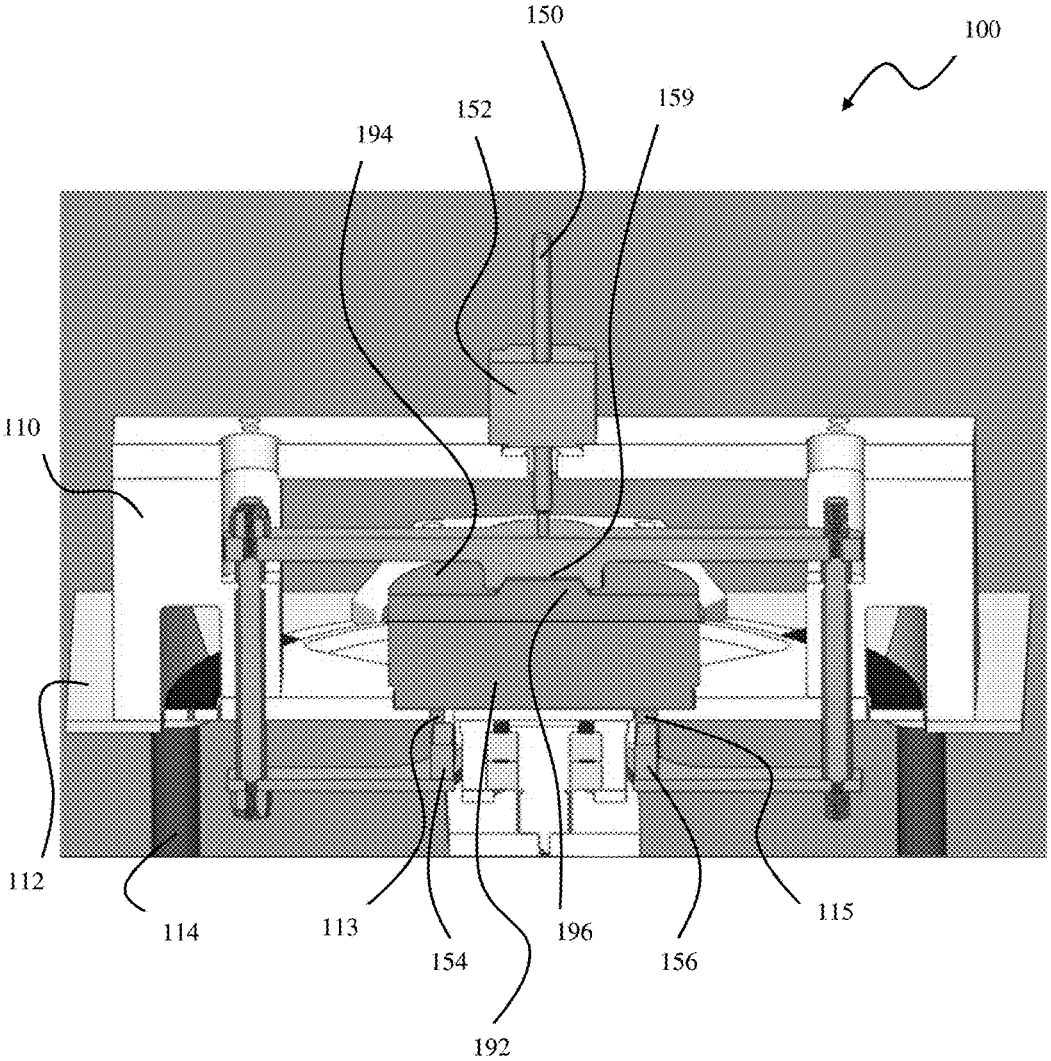
Figure 3:
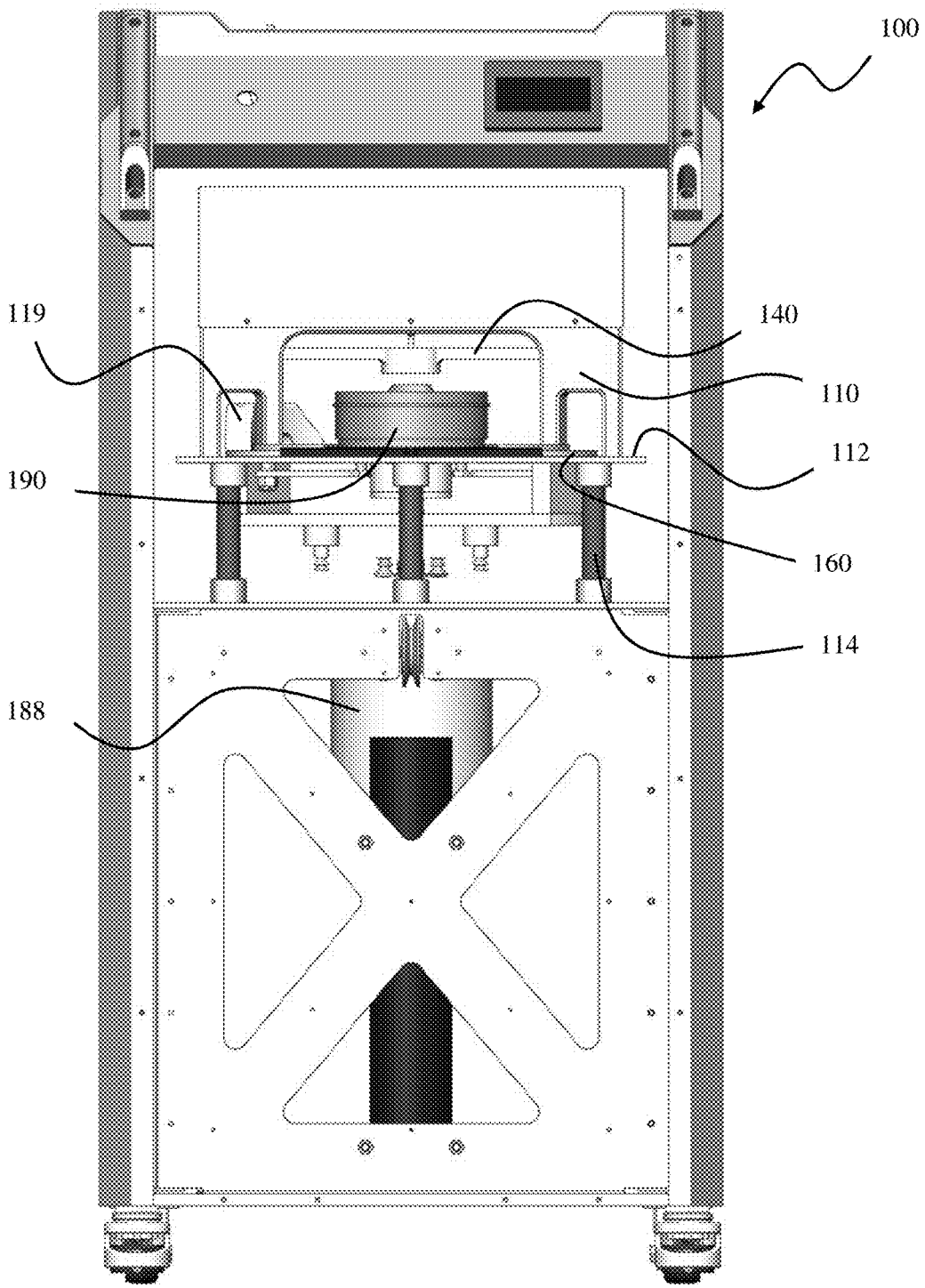
FIG. 3 is an internal elevational view of the grinding mill of FIG. 1.

Lift supports 154, 156 extend upward and are movable within respective openings 113, 115 within platform 112 that are defined by the floor of recess 117, and are at least as tall as the thickness (in other words, the height) of platform 112. Prior to loading dish 190, frame 140 can be set to a particular location relative to housing 110 and platform 112 such that the upper lift surfaces of lift supports 154, 156 are disposed above the floor of recess 117 and generally coincident with a plane defined by the upper surface of platform 112. This is shown in FIGS. 1 and 3. Thereafter, frame 140 can be lowered from this location to lower dish 190 into its fully seated position within recess 117, as shown in FIGS. 2 and 4. Similarly, frame 140 can be raised from its bottom/lower position so that a fully seated dish 190 is moved upward from the floor of recess 117 to a height above that is substantially coplanar with, or even higher than, the upper surface of platform 112. In other words, the upper surfaces of lift supports 154, 156 are movable in a vertical direction or path that extends from a location or height that is lower than or beneath the floor of recess 117 (as shown in FIGS. 2 and 4) to a location parallel to the upper surface of platform 112 (as shown in FIGS. 1 and 3). Movement of the upper surfaces of lift supports 154, 156 along this path allows them to be disposed lower than the lowest point of dish 190 when it is loaded into recess 117, and also to be disposed as high as the level of the upper surface of platform 112. Of course, reference to these points or positions is with respect to a plane at that height. This presence of lift supports 154, 156 in conjunction with the use of frame 140 facilitates loading and unloading dish 190 from its operative location by simply sliding it along the upper surface of platform 112. In other embodiments of the grinding mill, it is possible to incorporate a frame that employs lift supports without needing a housing, such that the frame cooperates only with the platform.

Upper support 148 also includes a boss 158 extending downward from its lower surface at a central location that coincides with a central portion of dish 190. Boss 158 defines a depression 159 so that it forms a cup-shaped feature positioned toward dish 190. Lid 194 of dish 190, on the other hand, defines a knob 196 extending upward from a central portion of its upper surface. The cross-sections of depression 159 and knob 196 can be similar in geometry so that a relatively secure connection can be made when boss 158 is in contact with lid 194 of dish 190, as shown in FIG. 2. Of course, in other embodiments, these elements can be reversed such that a boss is provided on lid 194 of dish 190 and a knob extends downward from the lower surface of upper support 148.

The movement of frame 140 and configuration of boss 158 also allow frame 140 to secure dish 190 in place during use of grinding mill 100. When dish 190 is disposed within recess 117 after being lowered by frame 140, further downward movement of frame 140 forces boss 158 into contact with lid 194, as shown in FIGS. 2 and 5. Downward force applied by step motor 152 to frame 140 via threaded rod 150 provides a secure force, which can be approximately 200 pounds in some embodiments, and heavier in others, to clamp dish 190 between boss 158 of frame 140 and the floor of recess 117 of platform 112. Likewise, the location of knob 196 within depression 159 of boss 158 further secures lid 194 from lateral movement. Because frame 140 moves relative to housing 110 and platform 112, the clamping provided by frame 140 to dish 190 can be maintained throughout use of grinding mill where all of those component are subject to the applied forces and oscillations.

During operation of grinding mill 100, materials to be pulverized are loaded into base 192 along with other pulverizing agents to be agitated during the process. The pulverizing agents can be free rings, pucks, and the like that can move in dish 190. Lid 194 is assembled onto base 192, and dish 190 is moved toward recess 117 of platform 112. Dish 190 is slid along the upper surface of platform 117 and guided by the mouth of U-shaped collar 170 until it is located immediately above recess 117, at which point dish 190 is seated on the upper surfaces of lift pads or supports 154, 156 of frame 140, as shown in FIG. 3. Frame 140 is then lowered through actuation of step motor 152 to lower dish 190 into its fully seated position within recess 117, as shown in FIG. 4. Continued downward movement of frame 140 via step motor 152 secures dish 190 in place by forcing boss 158 into contact with knob 196 of lid 194, as shown in FIG. 5. This effectively clamps dish 190 closed between boss 158 of frame 140 and the floor of recess 117 of platform 112.

Grinding mill 100 is then operated by causing the grinding motor 188 beneath platform 112 to create via the offset shaft an oscillation to grinding mill 100, in which dish 190 is secured. The oscillation movement of grinding mill 100 allows to pulverizing agents to rotate within dish 190, and it is the rotation of these pulverizing agents that grinds the materials to be pulverized, such as rock. This oscillation is produced by the offset distance from the axis of motor 188 facilitated by the offset flexible coupling that links motor 188 to annular disc 160. Nearly all of the forces are applied in a substantially horizontal direction. All elements of grinding mill 100 are subject to oscillation. These forces create tremendous agitation and swirling of the materials and pulverizing agents within dish 190, which causes interaction among the materials and pulverizing agents to break down and pulverize the materials as intended. This process can be carried out for as long as necessary to achieve the desired result with the material to be pulverized.

Centrifuge force created by counterweight 119 is compensated by the mass of dish 190 and of the overall structure oscillating in the opposite direction. To reach equilibrium between the two forces, the offset from the rotation axle needs to be variable. A lighter dish will produce less force during the oscillation, and automatically, the offset will be extended to counterbalance the centrifuge force produced by counterweight 119 in rotation. If the dish is heavier, the offset will be reduced to equilibrate the force. This is facilitated by the offset flexible coupling, such that annular disc 160 is attached to axle of motor 188 with an assembly of four high-duty elastic rubber bands (not shown) disposed in a near-diamond shape among grooves 189 to transmit the torque of motor 188 to the offset shaft. These rubber bands are taut between the tips of four uneven levers set at 90° one to another. Each lever has a groove 189 at its end. Because the levers are uneven in length, it forces an offset between the axis of motor 188 and the driven shaft. This creates an offset of approximately ½", for example, in the opposite direction with counterweight 119. This offset distance self-adjusts depending on the weight of dish 190 and its contents. The rubber bands do not circulate as drive belts would, but do rotate as they are attached to both the driving (motor) shaft and the driven (offset) shaft, which they link together in a semi-rigid fashion so as to allow the transmission of the motor shaft's rotational movement despite the offset distance with the driven shaft.

During operation of grinding mill 100, step motor 152 is exposed to rotation and translation forces. The translation force occur during the step of securing dish 190 into its operative position, and the rotational force occurs during operation of grinding mill 100. The firm and fixedly secure connection of step motor 152 to horizontal member 120 of housing 110 allows step motor 152 to endure these forces.

Once the pulverizing process is complete, frame 140 is raised to remove the clamping force on lid 194 and thereafter to allow lift supports 154, 156 to lift dish 190 out of recess 117. With dish 190 positioned at the upper surface of platform 112, dish 190 can be slid along platform 112 and away from recess 117. The hindrance of requiring such a heavily weighted dish 190 as a component of grinding mill 100 is minimized to a large extent, as the presence of frame 140 enhances the security of agitating such a heavy item and simplifies the process of loading and unloading dish 190.

During operation of grinding mill 100, the rotation of annular disc 160 can be monitored to detect if it is being rotated properly. More specifically, the amplitude of the platform during operation can be monitored. The system can monitor the torque and/or current draw of motor 188 used to rotate annular disc 160. Separately, the current used to power step motor 152 to maintain a clamping force on dish 190 is also monitored. If the system detects that the automatically controlled step motor 152 is requiring too little current, this would indicate that frame 140 is not being strongly enough applied to clamp dish 190 securely in place. If the system detects that the force to clamp dish 190 becomes too low so that lid 196 or dish 190 itself becomes loose, step motor 152 can either increase the force applied by frame 140 to dish 190 or trigger the system to shut down operation of grinding mill 100 in the interest of safety. A switch can also measure the precise location of dish 190 as to whether it is in recess 117 or not. Ultimately, inputs related to the overall vibration and oscillation of grinding mill 100 and movement of lid 196 can be monitored for safety purposes to shut down operation of grinding mill 100 under unsafe conditions.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A grinding mill system for pulverizing material, comprising:

a dish including a base and a lid;

a pulverizing agent disposed within the base;

a platform having an upper surface and defining a recess having a floor, the recess configured to seat the dish in which the material and the pulverizing agent are disposed; and a movable securing frame that is movably connected with the platform, the frame including a lift support having an upper surface that is movable along a path from a first location that is beneath the floor of the recess, through the recess, to a second location that is coplanar with the upper surface of the platform.

2. The grinding mill system of claim 1, further comprising a motor configured to cause oscillation of the platform and the movable securing frame.

3. The grinding mill system of claim 2, further comprising a counterweight configured to be rotated by the motor to counterbalance the oscillation of the platform and the movable securing frame.

4. The grinding mill system of claim 3, further comprising an annular disc to which the counterweight is secured.

5. The grinding mill system of claim 1, further comprising a housing rigidly secured to the platform.

6. The grinding mill system of claim 5, wherein the housing is disposed above the upper surface of the platform.

7. The grinding mill system of claim 6, further comprising an actuator and a rod connected to an upper support of the frame, wherein the actuator is configured to translate the rod to move the frame with respect to the housing.

8. The grinding mill system of claim 1, wherein the lift support is movable within an opening defined by the floor of the recess.

9. The grinding mill system of claim 1, further comprising a plurality of pillars supporting the platform, wherein each of the plurality of pillars is made of a rubber material.

10. The grinding mill system of claim 1, further comprising a U-shaped collar disposed on the upper surface of the platform to guide the dish toward the recess.

11. A grinding mill system for pulverizing material, comprising:

a dish including a base and a lid;

a pulverizing agent disposed within the base;

a platform having an upper surface and defining a recess having a floor, the recess configured to seat the dish in which the material and the pulverizing agent are disposed; and a movable securing frame having an upper support with a clamping surface and a lower support with a lift surface, the frame being movably connected with the platform along a path defining:

a first position in which the lift surface of the lower support is beneath the floor of the recess and the clamping surface is in contact with the dish to clamp the dish between the clamping surface and the floor of the recess; and a second position in which the lift surface of the lower support is coplanar with the upper surface of the platform.

12. The grinding mill system of claim 11, wherein a height of the lower support is at least as tall as a height of the platform.

13. The grinding mill system of claim 11, wherein the upper support of the frame has a boss extending downward from the clamping surface, the boss being cup-shaped and defining a depression that faces downward toward the lower support.

14. The grinding mill system of claim 13, wherein the lid of the dish has an upper surface and a knob extending upward from the upper surface.

15. The grinding mill system of claim 11, further comprising an actuator and a rod connected to the frame, wherein the actuator is configured to translate the rod to move the frame with respect to the platform.

16. A method of using a grinding mill system for pulverizing material, comprising the steps of:

placing a dish containing a pulverizing agent and materials to be pulverized above a recess defined by an upper surface of a platform, including seating the dish on an upper surface of a lift support of a movable securing frame that is movably connected with the platform;

lowering the frame with respect to the platform to lower the upper surface of the lift support through the recess to a location beneath a floor of the recess, thereby seating the dish within the recess; and oscillating the platform, the movable securing frame, and the dish.

17. The method of claim 16, wherein the step of oscillating further includes rotating a counterweight to counterbalance the oscillation of the platform, the movable securing frame, and the dish.

18. The method of claim 16, further comprising a step of lowering the frame further with respect to the platform to engage a boss extending downward from a lower surface of an upper support of the frame with the dish.

19. The method of claim 16, further comprising a step of clamping the dish between an upper support of the frame and the floor of the recess of the platform by lowering the frame further with respect to the platform.

20. The method of claim 16, further comprising a step of raising the frame with respect to the platform to raise the upper surface of the lift support through the recess to a location coplanar with the upper surface of the platform, thereby raising the dish out of the recess.

* * * * *